US008247045B2

(12) United States Patent
Shaw-Klein et al.

(10) Patent No.: US 8,247,045 B2
(45) **Date of Patent: *Aug. 21, 2012**

(54) INKJET RECORDING ELEMENT

(75) Inventors: Lori J. Shaw-Klein, Rochester, NY (US); Charles E. Romano, Jr., Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 1255 days.

This patent is subject to a terminal disclaimer.

(21) Appl. No.: 11/936,819

(22) Filed: Nov. 8, 2007

(65) Prior Publication Data

US 2009/0123675 A1 May 14, 2009

(51) Int. Cl.
*B41M 5/40* (2006.01)
*B41J 2/01* (2006.01)
*B41J 2/175* (2006.01)

(52) U.S. Cl. ..... 428/32.25; 428/32.34; 347/20; 347/86; 347/100; 347/105

(58) Field of Classification Search ..... 428/32.25, 428/32.34; 347/20, 86, 100, 105
See application file for complete search history.

(56) References Cited

U.S. PATENT DOCUMENTS

| | | | | |
|---|---|---|---|---|
| 4,877,686 | A | 10/1989 | Riou et al. | |
| 6,492,005 | B1 * | 12/2002 | Ohbayashi et al. | 428/32.29 |
| 6,641,875 | B2 * | 11/2003 | Sadasivan et al. | 428/32.35 |
| 7,015,270 | B2 | 3/2006 | Scharfe et al. | |
| 2002/0182380 | A1 * | 12/2002 | Nagashima et al. | 428/195 |
| 2003/0113516 | A1 * | 6/2003 | Wang et al. | 428/195 |
| 2003/0224129 | A1 * | 12/2003 | Miyachi et al. | 428/32.1 |
| 2004/0022968 | A1 | 2/2004 | Liu et al. | |
| 2005/0013947 | A1 * | 1/2005 | Merkel et al. | 428/32.34 |
| 2006/0078696 | A1 | 4/2006 | Furholz et al. | |
| 2006/0177608 | A1 | 8/2006 | Burch et al. | |
| 2009/0123655 | A1 | 5/2009 | Shaw-Klein et al. | |
| 2009/0123674 | A1 | 5/2009 | Shaw-Klein et al. | |

FOREIGN PATENT DOCUMENTS

| | | |
|---|---|---|
| EP | 0 493 100 | 7/1992 |
| EP | 1 464 511 | 10/2004 |
| JP | 2005-014611 | 1/2005 |
| JP | 2006-231914 | 9/2006 |
| JP | 2008-030441 | 2/2008 |
| WO | WO 2004/094158 | 11/2004 |
| WO | WO 2006/003391 | 1/2006 |
| WO | WO 2007/050462 | 5/2007 |
| WO | WO 2008/075047 | 6/2008 |
| WO | WO 2008/082475 | 7/2008 |

* cited by examiner

*Primary Examiner* — Gerard Higgins
*Assistant Examiner* — Sathavaram I Reddy

(57) ABSTRACT

An inkjet recording element is disclosed having a support and, on the support, (a) a porous base layer comprising particles of fumed silica and a hydrophilic binder and (b) an optional porous gloss layer above the base layer comprising particles of colloidal silica and a hydrophilic binder, wherein the particles of finned and colloidal silica are anionic. Also disclosed is a method of printing on such an inkjet recording element and a preferred method of making the inkjet recording element. The inkjet recording element can potentially have, in some embodiments, the advantages of improved image quality (reduced coalescence), and higher dye ink optical densities.

19 Claims, No Drawings

INKJET RECORDING ELEMENT

CROSS-REFERENCE TO RELATED APPLICATIONS

The present application is related to U.S. application Ser. No. 11/936,815 (Publication No. 2009/0123674), filed concurrently herewith, by Lori Shaw-Klein et al., and entitled, "INKJET RECORDING ELEMENT" and U.S. application Ser. No. 11/936,810 (Publication No. 2009/0123655), filed concurrently herewith, by Lori Shaw-Klein et al., and entitled, "PROCESS FOR MAKING INKJET RECORDING ELEMENT," both hereby incorporated by reference in their entirety.

FIELD OF THE INVENTION

The invention relates to an inkjet recording element and a method of printing on the recording element. More specifically, the invention relates to a porous recording element comprising a lower base layer, comprising anionic fumed silica with limited binder content and optionally an upper gloss layer for printing with pigment-base ink.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol, or mixtures thereof.

An inkjet recording element typically comprises a support having on at least one surface thereof at least one ink-receiving layer. There are generally two types of ink-receiving layers (IRL's). The first type of IRL comprises a non-porous coating of a polymer with a high capacity for swelling and absorbing ink by molecular diffusion. Cationic or anionic substances are typically added to the coating to serve as a dye fixing agent or mordant for the anionic or cationic dye, respectively. This coating is optically transparent and very smooth, leading to a high gloss "photo-grade" receiver. However, with this type of IRL, the ink is usually absorbed slowly into the IRL and the print is not instantaneously dry to the touch.

The second type of IRL comprises a porous coating of inorganic, polymeric, or organic-inorganic composite particles, a polymeric binder, and additives such as dye-fixing agents or mordants. These particles can vary in chemical composition, size, shape, and intra/inter-particle porosity. In this case, the printing liquid is substantially absorbed into the open pores of the IRL to obtain a print that is instantaneously dry to the touch.

Organic and/or inorganic particles in a porous layer form pores by the spacing between the particles. The binder is used to hold the particles together. However, to maintain a high pore volume, it is desirable that the amount of binder is limited. Too much binder would start to fill the pores between the particles or beads, which would reduce ink absorption. On the other hand, too little binder may reduce the integrity of the coating, thereby causing cracking.

As the quality and density of inkjet printing increases, so does the amount of ink applied to the inkjet recording element (also referred to as the "receiver"). For this reason, it is important to provide sufficient void capacity in the medium to prevent puddling or coalescence and inter-color bleed. At the same time, print speeds are increasing in order to provide convenience to the user. Thus, not only is sufficient capacity required to accommodate the increased amount of ink, but in addition, the medium must be able to handle increasingly greater ink flux in terms of ink volume/unit area/unit time.

A porous ink jet recording element usually contains at least two layers: a lower layer, sometimes referred to as a base layer as the main sump for the liquids in the applied inkjet ink, and an optional upper layer, sometimes referred to as a gloss layer, often an image-receiving layer, coated in that order on a support. The layers may be sub-divided or additional layers may be coated between the support and the uppermost gloss layer. The layers may be coated on a resin coated or a non-resin coated support. The layers maybe coated in one or more passes using known coating techniques such as roll coating, premetered coating (slot or extrusion coating, slide or cascade coating, or curtain coating) or air knife coating. When coating on a non-resin coated paper, in order to provide a smooth, glossy surface, special coating processes may be utilized, such as cast coating or film transfer coating. Calendering with pressure and optionally heat may also be used to increase gloss to some extent.

Recently, higher speed printing has been demanded of inkjet printers. A problem arises when multiple ink droplets are deposited in very close proximity in a short time. If the porosity of the receiver is not adequate, the drops will coalesce, severely degrading the image quality. The amount of binder in the coated layers is important in the performance of the ink-recording element. If too much binder is present, the porosity of the receiver is diminished resulting in coalescence, and if too little binder is present, unacceptable cracking is observed.

EP Patent Publication No. 1,464,511 to Bi et al. discloses a two-layer inkjet receiver on a resin-coated support. The bottom layer comprises a dispersion of fumed silica treated with aluminum chlorohydrate to transform the silica particles into a cationic form, as indicated by a zeta potential above +27 mv after treatment. The cationic silica particle dispersion was mixed with boric acid and poly(vinyl alcohol) to form a coating composition for the bottom layer. The coating composition for the top layer comprised a dispersion of cationic colloidal silica, glycerol, and a minor amount of coating aid. The top and bottom layers were cascade coated at the same time in one pass, that is, simultaneous coating is disclosed in context. The coating weight of the bottom layer was about 28 to 30 g/m$^2$ and the top layer was 0.2 g/m$^2$. However, there is a problem with this type of inkjet receiver in that image quality is reduced by coalescence when high ink levels are printed.

In the comparative example 4 of the above-mentioned EP Patent Publication No. 1,464,511. a comparative inkjet recording element with a cationic finned silica base layer and an anionic colloidal silica upper layer is made and tested.

US Patent Publication No. US 2003/0224129 to Miyachi et al. discloses an inkjet recording element similar to the above-mentioned EP Patent Publication No. 1,464,511 in which a layer mainly containing cationic colloidal silica is over a base layer containing cationized anionic inorganic particles that can be fumed silica.

U.S. Pat. No. 7,015,270 B2 to Scharfe et al. discloses an inkjet recording element comprising finned silica and a cationic polymer in which the dispersion used to make the inkjet recording element has a positive zeta potential.

It is known to provide crosslinker, for a binder in an ink-receiving layer, by diffusion of the crosslinker into the layer. For example, Riou, et al., in U.S. Pat. No. 4,877,686. describe a recording sheet for inkjet printing and a process for its preparation. The coating composition comprises filler, such as an inorganic particle, and a polyhydroxylic polymeric binder, such as poly (vinyl alcohol). In the coating process, the PVA is gelled or coagulated by borax. The gelling agent may be deposited on the base material prior to the coating. Alternatively, the gelling agent can be incorporated in the coating composition, but must be temporarily deactivated. For example, boric acid may be used in the coating composition and activated by contact with a higher pH base layer. A drawback of this incorporated crosslinker process is that although the boric acid does not completely gel the PVA coating composition, viscosity increases may be expected, which may have a negative impact on coating quality throughout a coating event. The disclosure of Riou, et al., is mainly directed to providing more regular-shaped dots. High print density and gloss demanded of a photographic quality print are not addressed by Riou, et al.

Kuroyama, et al., in EP Patent Publication No. EP 493,100, disclose an inkjet recording paper comprising a substrate which is coated with boric acid or borate and an inkjet recording layer formed on the borax-coating and comprising synthetic silica and poly(vinyl alcohol). The silica may be wet-process silica, silica gel, or ultrafine silica obtained by a dry process. The exemplary silica materials are silica gels with high surface area, but with large secondary particle size of several microns or more. These materials do not provide a high gloss expected for a photo-quality print. Cationic polyelectrolytes may be added to improve water resistance, thus implying a composition compatible with cationic species.

Liu et al., in US Patent Publication No. 2004/0022968. disclose an inkjet recording element including a substrate having thereon a) a subbing layer for a binder and a borate derivative and b) an image-receiving layer including a crosslinkable polymer and inorganic particles of, for example, cationically modified fumed silica or naturally cationic fumed alumina.

PROBLEM TO BE SOLVED BY THE INVENTION

It is an object of this invention to provide an inkjet receiver with improved color print density, reduced coalescence, and improved gloss while avoiding excessive cracking of the ink-receiving layer.

SUMMARY OF THE INVENTION

The present invention is directed to overcoming one or more of the problems set forth above. Briefly summarized, according to one aspect of the present invention, an inkjet recording element has a support and the following ink-receiving layers:

(a) a porous base layer comprising particles of anionic fumed silica, and hydrophilic hydroxyl-containing polymer as the primary binder crosslinked with crosslinker comprising boron-containing compound, wherein the base layer has a dry weight of about 10 to 35 g/m$^2$, wherein the weight percent of total binder to total solids in the base layer is greater than 5.0 percent and less than 15.0 percent; and (b) optionally, an uppermost porous gloss layer above the base layer comprising particles of anionic colloidal silica and a hydrophilic binder and having a dry weight of about 0.2 to 7.5 g/m$^2$; wherein the particles of anionic fumed silica and anionic colloidal silica exhibit a zeta potential below negative 15 mv; and wherein the ink-receiving layers in the inkjet recording element consists of one or two porous layers, either the porous base layer alone or the porous base layer and the uppermost porous gloss layer, above the support and any optional subbing layer.

In other words, the fumed silica in the base layer and the colloidal silica in the optional gloss layer are both anionic particles. In a preferred embodiment, the colloidal silica in the gloss layer comprises hydrophilic polymeric binder and is crosslinked with a crosslinking compound. In another preferred embodiment, the colloidal silica gloss layer has a dry weight of at least 1.5 g/m$^2$ and the median particle size of the colloidal silica in the uppermost layer is less than 40 nm.

The present invention has the advantages of improved image quality (reduced coalescence) and higher dye ink optical densities in an inkjet recording element. An inventive process of making such an element has the advantages of ease of handling precursor dispersions and improved properties of the resulting inkjet recording element, including improved gloss and reduced cracking for the elements having higher porosity in one or more layers of the element. It is very unexpected that an anionic composition for the ink-receiving layers in the inkjet recording element tends to provide better dye density than a comparable cationic formulation, especially since cationic materials would be expected to mordant more readily the typically used anionic dyes than anionic compositions for the ink-receiving layers. Surprising also, anionic compositions comprising anionic fumed silica tend to require less binder than comparable cationic fumed silica, as shown in examples.

In describing the invention herein, the following definitions generally apply:

The term "porous layer" is used herein to define a layer that is characterized by absorbing applied ink substantially by means of capillary action rather than liquid diffusion. The porosity is based on pores formed by the spacing between particles, although porosity can be affected by the particle to binder ratio. The porosity of a layer may be predicted based on the critical pigment volume concentration (CPVC). An inkjet recording element having one or more porous layers, preferably substantially all layers, over the support can be referred to as a "porous inkjet recording element," even if the support is not porous.

Particle sizes referred to herein, unless otherwise indicated, are number weighted particle sizes. In particular, in the case of colloidal silica, the median particle size is a number weighted median measured by electron microscopy, using high-resolution TEM (transmission electron microscopy) images, as will be appreciated by the skilled artisan. Herein each particle diameter is the diameter of a circle that has the same area as the equivalent projection area of each particle. In the case of colloidal silica, as compared to fumed silica, the colloidal particles may be aggregated on average up to about twice the primary particle diameter, which does not unduly affect the measurement of primary particle size.

In the case of mixtures of two populations of particles, the median particle size of the mixture is merely the median particle size of the mixture. Typically, for equal weights of two median particle sizes in a mixture, the median particle size of the mixture is relatively closer to the median particle size of the component having the smaller median particle size.

It is difficult to measure the secondary size of fumed metal oxide particles because the methods commonly used treat the particles as spheres and the results are calculated accordingly. (The primary particles sizes of fumed silica in a dispersion can be measured by TEM, as with colloidal silica.) Fumed silica particles are not spheres but consist of aggregates of primary particles. In the case of fumed silica, the median secondary particle size is as determined by light scattering measurements of diluted particles dispersed in water, as measured using laser diffraction or photon correlation spectroscopy (PCS) techniques employing NANOTRAC (Microtac Inc.), MALVERN, or CILAS instruments or essentially equivalent means. Unless otherwise indicated, particle sizes refer to secondary particle size. The median particle size of inorganic particles in various products sold by commercial manufacturers is usually provided in the product literature. However, for the purpose of making accurate comparisons among products, the particular measurement technique may need to be taken into consideration. Use of a single testing method eliminates potential variations among different testing methods.

As used herein, the terms "over," "above," "upper," "under," "below," "lower," and the like, with respect to layers in inkjet media, refer to the order of the layers over the support, but do not necessarily indicate that the layers are immediately adjacent or that there are no intermediate layers.

In regard to the present invention, the term "image-receiving layer" is intended to define a layer that is used as a pigment-trapping layer, dye-trapping layer, or dye-and-pigment-trapping layer, in which the printed image substantially resides throughout the layer. In the case of a dye-based ink, the image may optionally reside in more than one adjacent image-receiving layer.

In regard to the present invention, the term "gloss layer" is intended to define the uppermost coated layer in the inkjet recording element that provides additional gloss compared to the base layer alone. It is an image-receiving layer.

In regard to the present invention, the term "base layer" (sometimes also referred to as a "sump layer" or "ink-carrier-liquid receptive layer") is used herein to mean a layer under at least one other ink-retaining layer that absorbs a substantial amount of ink-carrier liquid. In use, a substantial amount, preferably most, of the carrier fluid for the ink is received and remains in the base layer until dried. The base layer is not above an image-receiving layer and is not itself an image-containing layer (a pigment-trapping layer or dye-trapping layer), although relatively small amounts of the ink colorant, in the case of a dye, may leave the image-receiving layer and enter the base layer, mostly in an upper portion. Preferably, the base layer is the ink-retaining layer nearest the support, with the exception of subbing layers. The base layer is the thickest layer under the image-receiving layer or layers.

The term "subbing layer" refers to any layer between the base layer and the support having a dry weight of less than 5 $g/m^2$, preferably less than 1 $g/m^2$. The subbing layer may be porous or non-porous and may be used to improve adhesion or accomplish some other function such as providing a crosslinking agent for diffusion.

The term "ink-receptive layer" or "ink-retaining layer" includes any and all layers above the support that are receptive to an applied ink composition, that absorb or trap any part of the one or more ink compositions used to form the image in the inkjet recording element, including the ink-carrier fluid and/or the colorant, even if later removed by drying. An ink-receptive layer, therefore, can include an image-receiving layer, in which the image is formed by a dye and/or pigment, a base layer, a subbing layer, or any additional layers, for example between a base layer and a topmost layer of the inkjet recording element. Typically, all layers above the support are ink-receptive. The support on which ink-receptive layers are coated may also absorb ink-carrier fluid. Whereas an ink-receptive layer is coated onto a support, the support is a solid material over which all the ink-receptive layers are coated during manufacture of the inkjet recording element.

DETAILED DESCRIPTION OF THE INVENTION

As indicated above, the present invention relates to a porous inkjet recording element comprising, over the support, a porous base layer nearest the support, and a porous upper gloss layer. The porous base layer nearest the support and porous upper gloss layer may optionally be divided into sub-layers, preferably immediately adjacent sub-layers, in which case independently the sub-layers individually and collectively meet the claim limitations of the layer, except for the thickness limitations. The layers, described herein, are preferably coated as a single layer.

In one embodiment, the inkjet recording element consists of a single porous base layer and a single upper gloss layer over the support, with the possible exception of layers less than 1 micrometer thick such as subbing layers.

In a preferred embodiment, the 60-degree gloss of the unprinted inkjet recording element is at least 15 Gardner gloss units, preferably at least 20 Gardner gloss units.

In a preferred embodiment, the present invention is directed to an inkjet recording element comprising, in order:

(a) a porous base layer comprising particles of anionic fumed silica, and hydrophilic hydroxyl-containing polymer as the primary binder, wherein the base layer has a dry weight of about 10 to 35 $g/m^2$, preferably 15 to 25 $g/m^2$, wherein the hydrophilic hydroxyl-containing polymer is crosslinked with crosslinker comprising boron-containing compound, wherein the weight percent of total binder to total solids in the base layer is greater than 5.0 percent and less than 15.0 percent, preferably less than 12 percent, most preferably less than 10 percent; and (b) a porous gloss layer above the base layer comprising particles of anionic colloidal silica and a hydrophilic binder and having a dry weight of about 1.0 to 7.5 $g/m^2$, wherein the median particle size of the particles of anionic colloidal silica is about 10 to less than 45 nm, preferably less than 40 nm, advantageously in some embodiments less than 30 nm, more preferably less than 25 nm.

The particles of both the fumed and colloidal silica exhibit a zeta potential below negative 15 mv.

The zeta potential is a measure of the surface charge of the particles, which can be shifted, for example, by any substances that become attached to the surface of the particles. Zeta potential is understood to mean the potential on the shearing surface of a particle in dispersion. In dispersions in which the particles carry acid or basic groups on the surface, the charge can be changed by setting the pH value. An important value in connection with the zeta potential is the isoelectric point (EP) of a particle, which can also be considered the zero point of charge. The IEP gives the pH value at which the zeta potential is zero. The IEP of silicon dioxide is less than pH 3.8. The greater the difference between the pH value and IEP, the more stable the dispersion.

Particles of the same material will have the same surface charge sign and will thus repel each other. However, if the zeta potential is too small, the repelling force cannot compensate for the van der Waals attraction of the particles and this will lead to flocculation and in some cases sedimentation of the particles.

The zeta potential can be determined in accordance with any method known in the art and preferably, for example, by measuring the colloidal vibration current (CVI) of the dispersion or by determining its electrophoretic mobility. The zeta potentials of the present compositions were measured on a Malvern instrument ZETASIZER NANO-ZS. Dispersions were diluted in water of matching pH and rolled to assure good dispersion.

The colloidal silica particles in the gloss layer may be further characterized by surface area BET surface measurement. The preferred surface area for the colloidal silica particles is above 50 $m^2/g$. Relatively larger surface areas among different colloidal silica products tend to be associated with smaller diameter particles. As used herein, the BET surface area measurement relies on the nitrogen adsorption method of S. Brunauer, P. H. Emmet and Teller, J. Am. Chemical Society, vol. 60. page 309 (1938).

As mentioned above, the amount of binder in an ink-receiving layer is desirably limited, because when ink is applied to inkjet media, the (typically aqueous) liquid carrier tends to swell the binder and close the pores and may cause bleeding or other problems. Preferably, therefore, the base layer comprises a less than an maximum amount of binder in the base layer, to maintain the desired porosity, preferably above a minimum amount of binder sufficient to prevent or eliminate cracking and other undesirable properties.

Any suitable hydrophilic hydroxyl-containing polymer crosslinkable by a boron-containing compound may be used as the primary binder in the base layer (optionally in the gloss layer) of the inkjet recording element.

The crosslinkable hydrophilic hydroxyl-containing polymer employed in at least the base layer may be, for example, poly(vinyl alcohol), partially hydrolyzed poly(vinyl acetate/vinyl alcohol), or copolymers containing hydroxyethylmethacrylate, copolymers containing hydroxyethylacrylate, copolymers containing hydroxypropylmethacrylate, hydroxy cellulose ethers such as hydroxyethylcellulose, etc. In a preferred embodiment, the crosslinkable polymer containing hydroxyl groups is poly(vinyl alcohol), including partially hydrolyzed poly(vinyl acetate/vinyl alcohol) or modified or unmodified PVA, or a copolymer of PVA comprising primarily (more than 50 mole percent) monomeric repeat units containing a hydroxy group, more preferably at least 70 mole percent of such monomeric repeat units.

In general, particularly good results are obtained employing, as the primary binder, poly(vinyl alcohol), also referred herein as "PVA." As indicated above, the term "poly(vinyl alcohol)" includes modified and unmodified poly(vinyl alcohol), for example, acetoacetylated, sulfonated, carboxylated PVA, and the like. Copolymers of PVA, for example with ethylene oxide, are also preferred as primary binder.

The polyvinyl alcohol) preferably employed in the present invention includes common poly(vinyl alcohol), which is prepared by hydrolyzing polyvinyl acetate, and also modified poly(vinyl alcohol) such as poly(vinyl alcohol) having an anionic or non-cationic group.

In one embodiment, the average degree of polymerization of the poly(vinyl alcohol) prepared by hydrolyzing vinyl acetate is preferably at least 300. but is more preferably 1000 to 10,000. or a preferred viscosity of at least 30 cP, more preferably at least 40 cP in water at a concentration of 4 percent by weight at 20 C. The saponification ratio of the poly(vinyl alcohol) is preferably 70% to 100%, but is more preferably 75% to 95%.

Lesser amounts of supplemental non-hydrophilic (hydrophobic) binders may also be included in various compositions. Preferred polymers are water-soluble, but latex polymer can also be included for various reasons. (As used herein, the term "primary" refers to greater than fifty percent by weight of all binder.)

In a preferred embodiment, the supplemental polymeric binder, if different from the primary binder, may be a compatible, preferably water-soluble hydrophilic polymer such as poly(vinyl pyrrolidone), gelatin, cellulose ethers, poly(oxazolines), poly(vinylacetamides), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan, methyl cellulose, hydroxypropyl cellulose, hydroxypropyl methyl cellulose, poly(2-ethyl-2-oxazoline), poly(2-methyl-2-oxazoline), poly(alkylene oxide), poly(vinyl pyrrolidinone), poly(vinyl acetate), polyurethanes, vinyl acetate-ethylene copolymers, ethylene-vinyl chloride copolymers, vinyl acetate-vinyl chloride-ethylene terpolymers, acrylic, polymers, copolymers or derivatives thereof and the like, or combinations thereof.

Preferred hydrophobic materials can include, for example, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, copolymers of vinylacetate and n-butylacrylate, and the like. Mixtures of hydrophilic and latex binders maybe useful, for example, mixtures of poly(vinyl alcohol) and poly(styrene-co-butadiene) latex.

With respect to the boron-containing crosslinker, most preferably, a boron-containing compound such as borate or borate derivative, is contained in a subbing layer and diffuses into base layer to crosslink the crosslinkable binder in at least the base layer.

A borate or borate derivative employed in the subbing layer of the ink jet recording element can be, for example, borax, sodium tetraborate, and the like, preferably not an acidic boron-containing compound such as boric acid.

In one embodiment, the crosslinking compound is a borate salt such as sodium tetraborate decahydrate (borax), sodium borate, and derivatives of boric acid, boric anhydride, and the like, employed in combination with, as binder in the base layer, a poly(vinyl alcohol), that is, "PVA." This combination has been found to be especially advantageous. It is known that PVA and borax interact to form a high viscosity or gelled mixture in solution that forms a crosslinked coating on drying. According to one embodiment, the borax is pre-coated on a web and then an aqueous coating composition containing the PVA is applied. The water from the coating composition solubilizes the borax, thus allowing it to diffuse through the coating, quickly thickening the composition.

The boron-containing compound, for example, the borate or borate derivative, is preferably used in an amount in a subbing layer of up to about twenty percent of the weight of the binder in the base layer. It is believed that upon coating of the base layer over such a dried subbing layer, most of the borate or borate derivative in the subbing layer diffuses into the base layer to crosslink most of the binder in the base layer, since such diffusion is typically rapid.

In order to impart further mechanical durability to the base layer, one or more supplemental, non-boron containing crosslinkers that act upon the binder discussed above may be added in small quantities to the coating composition for at least the base layer. Such an additive can further improve the cohesive strength of the layer. Crosslinkers such as carbodiimides, polyfunctional aziridines, aldehydes, isocyanates, epoxides, vinyl sulfones, pyridinium, pyridylium dication ether, methoxyalkyl melamines, triazines, dioxane derivatives, chrom alum, zirconium sulfate, and the like may be used. Thus, a non-boron-containing crosslinker can be used in combination with the boron-containing crosslinker.

As indicated above, the base layer has a dry weight of at least 10 $g/m^2$, more preferably 15 to 25 $g/m^2$, and most preferably 17 $g/m^2$ to 24 $g/m^2$. At lower dry weight of the base layer, any increased coalescence that is observed may be compensated further by adjusting the base layer composition to increase absorption capacity of the base layer or to improve wetability of the receiver. For example, the addition of fluorosurfactant to the base layer can reduce coalescence at low base-layer coverage. Also, coalescence may be reduced by adding absorption capacity in the form of an intermediate layer. Other possible adjustments to the composition of the base layer can include changing the surface area of the particles and/or the addition of other particulate materials.

The base layer is located under the other porous ink-retaining layers, at least the gloss layer, and absorbs a substantial amount of the liquid carrier applied to the inkjet recording element, but substantially less dye or pigment, if any, than the overlying layer or layers.

In one embodiment of the present inkjet recording element, the base layer is at least two times, preferably 3 times, more preferably at least 6 times, most preferably at least 9 times the thickness of the upper gloss layer.

The inorganic particles in the base layer can comprise a mixture of two different populations of fumed silica that are separately made and then admixed.

Preferably, the anionic fumed silica (or mixed-oxide fumed particle containing silicon) in the base layer comprises at least about 70 percent, more preferably at least about 90 percent, by weight of the total weight of inorganic particles in the base layer.

The base layer may further comprise a minor amount of one or more other non-cationic inorganic particles in addition to the finned silica, if any, for example, colloidal silica, titanium oxide, tin oxide, zinc oxide and the like and/or mixtures thereof Examples of other useful non-cationic inorganic particles include clay and calcium carbonate and the like. Preferably, any optional non-aggregated colloidal particles comprise anionic colloidal (non-aggregated) silica, as described above for the porous gloss layer, other than particle size.

In addition to the inorganic particles mentioned above, the base layer may independently contain non-cationic organic particles or beads such as poly(methyl methacrylate), polystyrene, poly(butyl acrylate), etc. Preferably, substantially all the particles in the base layer have a median primary and secondary particle size of not more than 300 nm.

Preferably, the one or more other non-cationic inorganic materials in the base layer comprise particles of a silicon-oxide containing material in which at least 70 percent, preferably at least 80 percent of the metal or silicon atoms are silicon, in combination with oxygen or other non-metallic or metallic atoms.

In a preferred embodiment, the base layer comprises between 5 and 15.0 weight percent binder. The base layer can comprise both hydrophilic and hydrophobic binder. Most preferably, the binder in the base layer comprises poly(vinyl alcohol). In addition, it is preferred that the base layer further comprises crosslinker crosslinking the poly(vinyl alcohol).

In one embodiment, the base layer further comprises fluorosurfactant, suitably in the amount of 0.1 to 5%, preferably 0.8 to 2% of the total weight of the coating composition. Preferred fluorosurfactants are non-ionic, linear, perfluorinated polyethoxylated alcohols, as disclosed in US Patent Application Publication No. 2005/0013947. hereby incorporated by reference. In some embodiments, such fluorosurfactants can improve gloss and coalescence.

The porous layers above the base layer contain interconnecting voids that can provide a pathway for the liquid components of applied ink to penetrate appreciably into the base layer, thus allowing the base layer to contribute to the dry time. A non-porous layer or a layer that contains closed cells would not allow underlying layers to contribute to the dry time.

The inkjet recording element preferably comprises, in the base layer famed silica having an average primary particle size of up to 50 nm, preferably 5 to 40 nm, but which is aggregated having a median secondary particle size preferably up to 300 nm, more preferably 150 to 250 nm.

The base layer is characterized by the absence of cationic materials that affect the surface charge or zeta potential of the anionic silica particles in the invention such as cationic polymer, a hydroxyl-containing polyvalent metal salt, for example aluminum chlorohydrate, or a silane coupling agent. "Absence" is defined herewith as below a limit in which there are sufficient cationic groups to critically change the zeta potential of the anionic silica particles, rendering the zeta potential more positive than negative 15 mv. The term "cationic polymer," for example, includes polymers with at least one quaternary ammonium group, phosphonium group, an acid adduct of a primary, secondary or tertiary amine group, polyethylene imines, polydiallylamines or polyallylamines, polyvinylamines, dicyandiamide condensates, dicyandiamide-polyamine co-condensates or polyamide-formaldehyde condensates, and the like.

Preferably, the fumed silica, like the colloidal silica in the present invention, is characterized by at least 70. preferably at least 90 percent of the metal or silicon atoms in the particles being silicon, in combination with oxygen or other non-metallic non-silicon atoms. For example, various dopants, impurities, variations in the composition of starting materials, surface agents, and other modifying agents may be added to the silicon oxide in limited amounts during its preparation, as long as the resulting surface is anionic. Fumed silica can include mixed metal oxides, as long as the zeta potential requirements are met. See, for example, U.S. Pat. No. 7,015,270 to Scharfe et al. and U.S. Pat. No. 6,808,769 to Batz-Sohn et al., both hereby incorporated by reference. Silicon-oxide mixed oxide particles can include, for example, titanium, aluminum, cerium, lanthamum, or zirconium atoms. Mixed oxides include intimate mixtures of oxide powders at an atomic level with the formation of mixed oxygen-metal/non-metal bonds.

Silicon-oxide particles can be divided roughly into particles that are made by a wet process and particles made by a dry process (vapor phase process). The latter type of particles is also referred to as fumed or pyrogenic particles. In a vapor phase method, flame hydrolysis methods and arc methods have been commercially used. The term "flame hydrolysis" is understood to mean the hydrolysis of metal or non-metal compounds in the gas phase of a flame, generated by reaction of a fuel gas, preferably hydrogen, and oxygen. Highly disperse, non-porous primary particles are initially formed which, as the reaction continues, coalesce to form aggregates, and these aggregates may congregate further to form agglomerates. In a preferred embodiment, the BET surface of area of these primary particles are 5 to 600 $m^2/g$. Fumed silica is produced in a vapor phase process, whereas colloidal silica is not and can be distinguished from both fumed silica made by a dry process and other silicas made by a wet process such as relatively more porous silica gel.

Fumed particles exhibit different properties than non-fumed or wet-process particles, which are referred to herein as "colloidal silica." In the case of fumed silica, this may be due to the difference in density of the silanol group on the surface. Fumed particles are suitable for forming a three-dimensional structure having high void ratio.

Fumed or pyrogenic particles are aggregates of smaller, primary particles. Although the primary particles are not porous, the aggregates contain a significant void volume, and hence are capable of rapid liquid absorption. These void-containing aggregates enable a coating to retain a significant capacity for liquid absorption even when the aggregate particles are densely packed, which minimizes the inter-particle void volume of the coating. For example, fumed silica, for selective optional use in the present invention, are described in U.S. Pat. No. 6,808,769 to Batz-Sohn et al., U.S. Pat. No. 6,964,992 to Morris et al. and U.S. Pat. No. 5,472,493 to Regan, all hereby incorporated by reference. Examples of finned silica are provided in the Examples below and are commercially available, for example, from Cabot Corp. under the family trademark CAB-O-SIL silica, or Degussa under the family trademark AEROSIL silica.

Fumed silicas having relatively lower surface area are preferred for their lower binder requirement, but fumed silicas with surface areas that are too low decrease gloss. In one embodiment, a range of 150 to 350 $m^2/g$ is preferred, more preferably 170 to 270 $m^2/g$.

Coated over the base layer is the upper gloss layer. The voids in the gloss-layer provide a pathway for an ink to penetrate appreciably into the base layer, thus allowing the base layer to contribute to the dry time. It is preferred, therefore, that the voids in the gloss-producing ink-receiving layer are open to (connect with) and preferably (but not necessarily) have a void size similar to or slightly larger than the voids in the base layer for optimal interlayer absorption.

In one embodiment, the upper gloss layer comprises less than 10 weight percent binder, based on total solids in the layer. The binders in the upper gloss layer can be selected from the same binders as in the base layer. Poly(vinyl alcohol) is again the preferred binder.

The gloss layer is characterized by the absence of cationic materials that affect the surface charge or zeta potential of the silica particles in the invention such as cationic polymer, a hydroxyl-containing polyvalent metal salt, for example aluminum chlorohydrate, or a silane coupling agent. "Absence" is defined herewith as below a limit in which there are sufficient cationic groups to critically change the zeta potential of the anionic silica particles, rendering the zeta potential more positive than negative 15 mv.

Preferably, the colloidal silica in the gloss layer comprises at least about 80 percent, more preferably 90 percent, by weight of the inorganic particles in the gloss layer.

The term "colloidal silica" refers to particles comprising silicon dioxide that are dispersed to become colloidal. Such colloidal particles characteristically are primary particles that are substantially spherical. Larger particles, aggregates of primary particles relatively limited in number and aggregation, may be present to a minor extent, depending on the particular material and its monodispersity or polydispersity, but the larger particles have a relatively minor effect on the number weighted median particle size. Examples of these colloidal silica are described in the Examples below and are commercially available from a number of manufacturers, including Nissan Chemical Industries, Degussa, Grace Davison (for example under the family trademarks SYLOJET and LUDOX), Nalco Chemical Co., etc. Typically, colloidal silica naturally has an anionic charge, resulting from the loss of protons from silanol groups present on the particles' surface. Such particles typically originate from dispersions or sols in which the particles do not settle from dispersion over long periods of time. Most commercially available colloidal silica sols contain sodium hydroxide, which originates at least partially from the sodium silicate used to make the colloidal silica.

The average metallic composition of said colloidal particles comprises at least 70 percent, more preferably at least 90 percent silicon, wherein silicon is considered a metallic element for this calculation, as described above for the fumed silica in the base layer.

The gloss layer may further comprise a minor amount of one or more other non-cationic inorganic particles, if any, for example, fumed silica, titanium oxide, and/or mixtures thereof Preferably, any optional aggregated particles comprise anionic fumed silica, as described above for the porous base layer, other than particle size. Also suitable are anionic colloidal particles of zinc oxide, tin oxide, and the like.

In addition to the inorganic particles mentioned above, the gloss layer may independently contain non-cationic organic particles or beads such as the ones mentioned above for the base layer. Preferably, substantially all the particles in the base layer have an average primary particle size of not more than 45 nm, except for particles used as matte beads.

Preferably, the one or more other non-cationic inorganic materials in the gloss layer comprise particles of a silicon-oxide containing material in which at least 80 percent of the metal or silicon atoms are silicon, in combination with oxygen or other non-metallic or metallic atoms.

Conventional additives may be included in the ink-receiving layers in the present invention, which may depend on the particular use for the recording element. Such additives that optionally can be included in the ink-receiving layers of the inkjet recording element include cross-linkers, rheology modifiers, surfactants, UV-absorbers, biocides, lubricants, dyes, optical brighteners, and other conventionally known additives. Additives may be added in light of the fact that the inkjet recording element may come in contact with other image recording articles or the drive or transport mechanisms of image-recording devices, so that additives such as matte particles and the like may be added to the inkjet recording element to the extent that they do not degrade the properties of interest. Also the additives must be compatible with anionic silica.

The inkjet recording element can be specially adapted for either pigmented inks or dye-based inks, or designed for both. In the case of pigment-based inks, the upper gloss layer can function as a pigment-trapping layer. In the case of dye-based inks, both the upper gloss layer and the lower base layer, or an upper portion thereof, may contain the image, depending on the particular embodiment, thickness of the layers, particle composition, binder, etc.

The term "pigment-trapping layer" is used herein to mean that, in use, preferably at least about 75% by weight, more preferably substantially all, of the pigment colorant in the inkjet ink composition used to print an image remains in the pigment-trapping layer.

The support for the coated ink-retaining layers may be selected from plain papers or resin-coated paper. Preferably the resin-coated paper comprises a polyolefin coating on both sides, more preferably polyethylene. The thickness of the support employed in the invention can be from about 12 to about 500 μm, preferably from about 75 to about 300 μm.

If desired, in order to improve the adhesion of the base layer to the support, the surface of the support or a subbing layer may be corona-discharge-treated prior to applying the base layer to the support.

The inkjet recording element of the present invention can be manufactured by conventional manufacturing techniques known in the art. In a particularly preferred method, the subbing layer is coated in a single layer at a single station and all the additional coating layers, comprising the base and optional gloss layers, are simultaneously coated in a single station. In one embodiment, the entire inkjet recording element is coated in a single coating pass.

The term "single coating pass" or "one coating pass" refers to a coating operation comprising coating one or more layers, optionally at one or more stations, in which the coating operation occurs prior to winding the inkjet recording material in a roll. A coating operation, in which a further coating step occurs before and again after winding the inkjet recording material on a roll, but prior to winding the inkjet recording material in a roll a second time, is referred to as a two-pass coating operation.

The term "post-metering method" is defined herewith as a method in which the coating composition is metered after coating, by removing excess material that has been coated.

The term "pre-metering method," also referred to as "direct metering method," is defined herewith as a method in which the coating composition is metered before coating, for example, by a pump.

Pre-metered methods can be selected from, for example, curtain coating, extrusion hopper coating slide hopper coating, and the like.

In a preferred embodiment, the two ink-receiving layers are simultaneously coated, preferably by curtain coating.

In a preferred embodiment, the method of manufacturing an inkjet recording element comprises the steps of:

(a) providing a support;

(b) simultaneously coating in order over the support;

(i) a first coating composition, for a base layer, comprising particles of anionic fumed silica and a hydrophilic binder capable of being substantially cross-linked by crosslinking compound not contained in the first composition; and (ii) a second optional coating composition, for a gloss layer, comprising particles of anionic colloidal silica and a binder;

wherein said particles of fumed silica and colloidal silica exhibit a zeta potential below negative 15 mv, wherein the percent of binder to total solids in the first and second coating compositions is between 5% and 15.0% by weight (not including 15.0 percent); and (c) treating the support prior to step (b) with a subbing composition comprising a crosslinking compound that diffuses into at least the base layer to substantially crosslink at least the hydrophilic binder in the base layer.

The subbing composition can optionally comprise a binder or may simply comprise a liquid carrier such as water.

Preferably, the crosslinking compound contains boron, for example, the crosslinking compound can be borax or borate.

In a preferred embodiment of the method, the hydrophilic binder in the base layer comprises poly(vinyl alcohol) or a derivative or co-polymer thereof.

The binder in the gloss layer can also be capable of being substantially crosslinked by crosslinking compound not contained in the second composition and wherein said crosslinking compound also diffuses into the gloss layer to substantially crosslink the binder in the gloss layer.

Thus, in one embodiment, the support is treated prior to step (b) with a subbing composition comprising a crosslinking compound that diffuses into at least the base layer to substantially crosslink at least the hydrophilic binder in the base layer. In this case, the crosslinking compound may migrate to some extent into the optional upper gloss layer, depending on various factors such as the thickness of the base layer.

Further intermediate layers between the base layer and the optional upper gloss layer, etc. may be coated by conventional pre-metered coating means as enumerated above. Preferably, the base layer and the optional gloss layer are the only two layers having a dry weight over 1.0 g/m$^2$ in the ink-receiving element.

Another aspect of the invention relates to an inkjet printing method comprising the steps of: (a) providing an inkjet printer that is responsive to digital data signals; (b) loading the inkjet printer with the inkjet recording element described above; (c) loading the inkjet printer with a pigmented inkjet ink; and (d) printing on the inkjet recording element using the inkjet ink in response to the digital data signals.

Yet another aspect of the invention relates to a packaged product set comprising the inkjet receiver of the present invention in combination with an inkjet ink set comprising at least three colored pigmented ink compositions, for example, cyan, yellow, and magenta. Such a product set can conveniently be made commercially available to customers for use in printing photo-quality images, so that the ink compositions and the inkjet receiver are desirably matched during printing of images. The inkjet recording element of the present invention can further be characterized by the presence, on the backside thereof, of indicia that are capable of being detected by an inkjet printer. Such indicia can be detected by an optical detector or other such means in order to further improve the desired result by ensuring the recommended printer settings for a particular inkjet receiver are used when printing an image. This system allows the user to achieve higher print quality more conveniently.

In a preferred embodiment, the inkjet ink composition is applied onto the inkjet recording element at a rate of at least $5.0\times10^{-4}$ ML/cm$^2$/sec without loss of image quality. This ink flux corresponds to printing a photograph at an addressable resolution of 1200 by 1200 pixels per inch with an average ink volume of 10.35 picoliters (pL) per pixel in 42 seconds, wherein the printing of a given pixel by multiple coating passes is complete in less than 4 seconds.

Inkjet inks used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. If dyes are used in such compositions, they are typically water-soluble direct or acid type dyes. Such liquid compositions have been described extensively in the prior art including, for example, U.S. Pat. Nos. 4,381,946; 4,239,543; and 4,781,758.

The ink compositions known in the art of inkjet printing may be aqueous- or solvent-based, and in a liquid, solid or gel state at room temperature and pressure. Aqueous-based ink compositions are preferred because they are more environmentally friendly as compared to solvent-based inks, plus most printheads are designed for use with aqueous-based inks.

The ink composition may be colored with pigments, dyes, polymeric dyes, loaded-dye/latex particles, or any other types of colorants, or combinations thereof. Pigment-based ink compositions are preferred because such inks render printed images giving comparable optical densities with better resistance to light and ozone as compared to printed images made from other types of colorants. The colorant in the ink composition may be yellow, magenta, cyan, black, gray, red, violet, blue, green, orange, brown, etc.

A challenge for inkjet printing is the stability and durability of the image created on the various types of ink jet receivers. It is generally known that inks employing pigments as ink colorants provide superior image stability relative to dye based inks for light fade and fade due to environmental pollutants especially when printed on microporous photoglossy receivers. For good physical durability (for example abrasion resistance) pigment based inks can be improved by addition of a binder polymer in the ink composition.

Ink compositions useful in the present printing method or packaged product set are aqueous-based. Aqueous-based, is defined herewith as the majority of the liquid components in the ink composition are water, preferably greater than 50% water and more preferably greater than 60% water.

The water compositions usefull in the ink compositions may also include humectants and/or co-solvents in order to prevent the ink composition from drying out or crusting in the nozzles of the printhead, aid solubility of the components in the ink composition, or facilitate penetration of the ink composition into the image-recording element after printing. Representative examples of humectants and co-solvents used in aqueous-based ink compositions include (1) alcohols, such as methyl alcohol, ethyl alcohol, n-propyl alcohol, isopropyl alcohol, n-butyl alcohol, sec-butyl alcohol, t-butyl alcohol, iso-butyl alcohol, furfuryl alcohol, and tetrahydrofurfuryl alcohol; (2) polyhydric alcohols, such as ethylene glycol, diethylene glycol, triethylene glycol, tetraethylene glycol, propylene glycol, polyethylene glycol, polypropylene glycol, 1,2-propane diol, 1,3-propane diol, 1,2-butane diol, 1,3-butane diol, 1,4-butane diol, 1,2-pentane diol, 1,5-pentanediol, 1,2-hexanediol, 1,6-hexane diol, 2-methyl-2,4-pentanediol, 1,2-heptane diol, 1,7-hexane diol, 2-ethyl-1,3-hexane diol, 1,2-octane diol, 2,2,4-trimethyl-1,3-pentane diol, 1,8-octane diol, glycerol, 1,2,6-hexanetriol, 2-ethyl-2-hydroxymethylpropane diol, saccharides and sugar alcohols, and thioglycol; (3) lower mono- and di-alkyl ethers derived from the polyhydric alcohols; such as, ethylene glycol monomethyl ether, ethylene glycol monobutyl ether, ethylene glycol monoethyl ether acetate, diethylene glycol monomethyl ether, and diethylene glycol monobutyl ether acetate; (4) nitrogen-containing compounds such as urea, 2-pyrrolidone, N-methyl-2-pyrrolidone, and 1,3-dimethyl-2-imidazolidinone; and (5) sulfur-containing compounds such as 2,2'-thiodiethanol, dimethyl sulfoxide and tetramethylene sulfone.

The ink compositions are pigment-based in the present printing method or packaged product set because such inks render printed images having higher optical densities and better resistance to light and ozone as compared to printed images made from other types of colorants. Pigments that may be used include those disclosed in, for example, U.S. Pat. Nos. 5,026,427; 5,086,698; 5,141,556; 5,160,370; and 5,169,436. The exact choice of pigments will depend upon the specific application and performance requirements such as color reproduction and image stability.

Pigments suitable for use in the present printing method or packaged product set include, but are not limited to, azo pigments, monoazo pigments, disazo pigments, azo pigment lakes, b-Naphthol pigments, Naphthol AS pigments, benzimidazolone pigments, disazo condensation pigments, metal complex pigments, isoindolinone and isoindoline pigments, polycyclic pigments, phthalocyanine pigments, quinacridone pigments, perylene and perinone pigments, thioindigo pigments, anthrapyrimidone pigments, flavanthrone pigments, anthanthrone pigments, dioxazine pigments, triarylcarbonium pigments, quinophthalone pigments, diketopyrrolo pyrrole pigments, titanium oxide, iron oxide, and carbon black.

Typical examples of pigments that may be used include Color Index (C. I.) Pigment Yellow 1, 2, 3, 5, 6, 10, 12, 13, 14, 16, 17, 62, 65, 73, 74, 75, 81, 83, 87, 90, 93, 94, 95, 97, 98, 99, 100, 101, 104, 106, 108, 109, 110, 111, 113, 114, 116, 117, 120, 121, 123, 124, 126, 127, 128, 129, 130, 133, 136, 138, 139, 147, 148, 150, 151, 152, 153, 154, 155, 165, 166, 167, 168, 169, 170, 171, 172, 173, 174, 175, 176, 177, 179, 180, 181, 182, 183, 184, 185, 187, 188, 190, 191, 192, 193, 194; C. 1. Pigment Red 1, 2, 3, 4, 5, 6, 7, 8, 9, 10, 11, 12, 13, 14, 15, 16, 17, 18, 21, 22, 23, 31, 32, 38, 48:1, 48:2, 48:3, 48:4, 49:1, 49:2, 49:3, 50:1, 51, 52:1, 52:2, 53:1, 57:1, 60:1, 63:1, 66, 67, 68, 81, 95, 112, 114, 119, 122, 136, 144, 146, 147, 148, 149, 150, 151, 164, 166, 168, 169, 170, 171, 172, 175, 176, 177, 178, 179, 181, 184, 185, 187, 188, 190, 192, 194, 200, 202, 204, 206, 207, 210, 211, 212, 213, 214, 216, 220, 222, 237, 238, 239, 240, 242, 243, 245, 247, 248, 251, 252, 253, 254, 255, 256, 258, 261, 264; C.I. Pigment Blue 1, 2, 9, 10, 14, 15:1, 15:2, 15:3, 15:4, 15:6, 15, 16, 18, 19, 24:1, 25, 56, 60, 61, 62, 63, 64, 66, bridged aluminum phthalocyanine pigments; C.I. Pigment Black 1, 7, 20, 31, 32; C.I. Pigment Orange 1, 2, 5, 6, 13, 15, 16, 17, 17:1, 19, 22, 24, 31, 34, 36, 38, 40, 43, 44, 46, 48, 49, 51, 59, 60, 61, 62, 64, 65, 66, 67, 68, 69; C.I. Pigment Green 1, 2, 4, 7, 8, 10, 36, 45; C.I. Pigment Violet 1, 2, 3, 5:1, 13, 19, 23, 25, 27, 29, 31, 32, 37, 39, 42, 44, 50, and mixtures thereof.

Self-dispersing pigments that are dispersible without the use of a dispersant or surfactant may also be useful in the present printing method or packaged product set. Pigments of this type are those that have been subjected to a surface treatment such as oxidation/reduction, acid/base treatment, or functionalization through coupling chemistry, such that a separate dispersant is not necessary. The surface treatment can render the surface of the pigment with anionic, cationic or non-ionic groups. See for example, U.S. Pat. No. 6,494,943 and U.S. Pat. No. 5,837,045. Examples of self-dispersing type pigments include Cab-O-Jet 200â and Cab-O-Jet 300â (Cabot Specialty Chemicals, Inc.) and Bonjet CW-1â. CW-2â and CW-3â (Orient Chemical Industries, Ltd.). In particular, a self-dispersing carbon black pigment ink may be employed in the ink set used in the present printing method or packaged product set, wherein ink comprises a water soluble polymer containing acid groups neutralized by an inorganic base, and the carbon black pigment comprises greater than 11 weight % volatile surface functional groups as disclosed in commonly assigned, copending U.S. Ser. No. 60/892,137. the disclosure of which is incorporated by reference herein.

Pigment-based ink compositions useful in the present printing method or packaged product set may be prepared by any method known in the art of inkjet printing. Useful methods commonly involve two steps: (a) a dispersing or milling step to break up the pigments to primary particles, where primary particle is defined as the smallest identifiable subdivision in a particulate system, and (b) a dilution step in which the pigment dispersion from step (a) is diluted with the remaining ink components to give a working strength ink.

The milling step (a) is carried out using any type of grinding mill such as a media mill, ball mill, two-roll mill, three-roll mill, bead mill, and air-jet mill, an attritor, or a liquid interaction chamber. In the milling step (a), pigments are optionally suspended in a medium that is typically the same as or similar to the medium used to dilute the pigment dispersion in step (b). Inert milling media are optionally present in the milling step (a) in order to facilitate break up of the pigments to primary particles. Inert milling media include such materials as polymeric beads, glasses, ceramics, metals, and plastics as described, for example, in U.S. Pat. No. 5,891,231.

Milling media are removed from either the pigment dispersion obtained in step (a) or from the ink composition obtained in step (b).

A dispersant is optionally present in the milling step (a) in order to facilitate break up of the pigments into primary particles. For the pigment dispersion obtained in step (a) or the ink composition obtained in step (b), a dispersant is optionally present in order to maintain particle stability and prevent settling. Dispersants suitable for use include, but are not limited to, those commonly used in the art of ink jet printing. For aqueous pigment-based ink compositions, useful dispersants include anionic, cationic, or nonionic surfactants such as sodium dodecylsulfate, or potassium or sodium oleylmethyltaurate as described in, for example, U.S. Pat. Nos. 5,679,138; 5,651,813; or 5,985,017.

Polymeric dispersants are also known and useful in aqueous pigment-based ink compositions. Polymeric dispersants may be added to the pigment dispersion prior to, or during the milling step (a), and include polymers such as homopolymers and copolymers; anionic, cationic, or nonionic polymers; or random, block, branched, or graft polymers. Polymeric dispersants useful in the milling operation include random and block copolymers having hydrophilic and hydrophobic portions; see for example, U.S. Pat. Nos. 4,597,794; 5,085,698; 5,519,085; 5,272,201; 5,172,133; or 6,043,297; and graft copolymers; see for example, U.S. Pat. Nos. 5,231,131; 6,087,416; 5,719,204; or 5,714,538.

Composite colorant particles having a colorant phase and a polymer phase are also useful in aqueous pigment-based inks. Composite colorant particles are formed by polymerizing monomers in the presence of pigments; see for example, US Publication Nos. 2003/0199614, 2003/0203988, or 2004/0127639. Microencapsulated-type pigment particles are also useful and consist of pigment particles coated with a resin film; see for example U.S. Pat. No. 6,074,467.

The pigments used in the ink compositions useful in the present printing method or packaged product set may be present in any effective amount, generally from 0.1 to 10% by weight and preferably from 0.5 to 6% by weight.

Ink jet ink compositions may also contain non-colored particles such as inorganic particles or polymeric particles. The use of such particulate addenda has increased over the past several years, especially in ink jet ink compositions intended for photographic-quality imaging. For example, U.S. Pat. No. 5,925,178 describes the use of inorganic particles in pigment-based inks in order to improve optical density and rub resistance of the pigment particles on the image-recording element. In another example, U.S. Pat. No. 6,508,548 describes the use of a water-dispersible polymeric latex in dye-based inks in order to improve light and ozone resistance of the printed images.

The ink composition may contain non-colored particles such as inorganic or polymeric particles in order to improve gloss differential, light and/or ozone resistance, waterfastness, rub resistance and various other properties of a printed image; see for example, U.S. Pat. Nos. 6,598,967 or 6,508,548. Colorless ink compositions that contain non-colored particles and no colorant may also be used. For example US Patent Publication No. 2006/0100307 describes an inkjet ink comprising an aqueous medium and microgel particles. Colorless ink compositions are often used in the art as "fixers" or insolubilizing fluids that are printed under, over, or with colored ink compositions in order to reduce bleed between colors and waterfastness on plain paper; see for example, U.S. Pat. Nos. 5,866,638 or 6,450,632. Colorless inks are also used to provide an overcoat to a printed image, usually in order to improve scratch resistance and waterfastness; see for example, US Patent Publication No. 2003/0009547 or EP Patent Publication No. 1,022,151. Colorless inks are also used to reduce gloss differential in a printed image; see for example, U.S. Pat. No. 6,604,819; or US Patent Publication Nos. 2003/0085974; 2003/0193553; and 2003/0189626.

Examples of inorganic particles that may be useful in the inks include, but are not limited to, alumina, boehmite, clay, calcium carbonate, titanium dioxide, calcined clay, aluminosilicates, silica, or barium sulfate.

For aqueous-based inks, polymeric binders useful in the inks include water-dispersible polymers generally classified as either addition polymers or condensation polymers, both of which are well-known to those skilled in the art of polymer chemistry. Examples of polymer classes include acrylics, styrenics, polyethylenes, polypropylenes, polyesters, polyamides, polyurethanes, polyureas, polyethers, polycarbonates, polyacid anhydrides, and copolymers consisting of combinations thereof. Such polymer particles can be ionomeric, film-forming, non-film-forming, fusible, or heavily cross-linked and can have a wide range of molecular weights and glass transition temperatures.

Examples of useful polymeric binders include styrene-acrylic copolymers sold under the trade names Joncryl (S.C. Johnson Co.), Ucar™ (Dow Chemical Co.), Jonrez (Mead-Westvaco Corp.), and Vancryl (Air Products and Chemicals, Inc.); sulfonated polyesters sold under the trade name Eastman AQ (Eastman Chemical Co.); polyethylene or polypropylene resin emulsions and polyurethanes (such as the Witcobonds™ from Witco). These polymers are preferred because they are compatible in typical aqueous-based ink compositions, and because they render printed images that are highly durable towards physical abrasion, light and ozone.

The non-colored particles and binders that may be useful in the ink compositions may be present in any effective amount, generally from 0.01 to 20% by weight, and preferably from 0.01 to 6% by weight. The exact choice of materials will depend upon the specific application and performance requirements of the printed image.

Ink compositions may also contain water-soluble polymer binders. The water-soluble polymers useful in the ink composition are differentiated from polymer particles in that they are soluble in the water phase or combined water/water-soluble solvent phase of the ink. The term "water-soluble" is defined herein as when the polymer is dissolved in water and when the polymer is at least partially neutralized the resultant solution is visually clear. Included in this class of polymers are nonionic, anionic, amphoteric, and cationic polymers. Representative examples of water soluble polymers include, polyvinyl alcohols, polyvinyl acetates, polyvinyl pyrrolidones, carboxy methyl cellulose, polyethyloxazolines, polyethyleneimines, polyamides, and alkali soluble resins; polyurethanes (such as those found in U.S. Pat. No. 6,268,101); and polyacrylic type polymers such as polyacrylic acid and styrene-acrylic methacrylic acid copolymers (such as; as Joncryl 70 from S.C. Johnson Co., TruDot™ IJ-4655 from Mead-Westvaco Corp., and Vancryl 68S from Air Products and Chemicals, Inc.

Examples of water-soluble acrylic-type polymeric additives and water dispersible polycarbonate-type or polyether-type polyurethanes which may be used in the inks of the ink sets useful in the present printing method or packaged product set are described in copending, commonly assigned U.S. Ser. Nos. 60/892,158 and 60/892,171. the disclosures of which are incorporated by reference herein. Polymeric binder additives useful in inks of an ink set are also described in, for example, US Patent Publication Nos. 2006/0100307 and 2006/0100308.

Preferably, ink static and dynamic surface tensions are controlled so that inks of an ink set can provide prints with the desired inter-color bleed. In particular, it has been found that the dynamic surface tension at 10 milliseconds surface age for all inks of the ink set comprising cyan, magenta, yellow, and black pigment-based inks and a colorless protective ink should preferably be greater than or equal to 35 mN/m, while the static surface tensions of the yellow ink and of the colorless protective ink should be at least 2.0 mN/m lower than the static surface tensions of the cyan, magenta, and black inks of the ink set, and the static surface tension of the colorless protective ink should be at least 1.0 mN/m lower than the static surface tension of the yellow ink, in order to provide acceptable performance for inter-color bleed on both microporous photoglossy and plain paper. In preferred embodiments, the static surface tension of the yellow ink is at least 2.0 mN/m lower than all other inks of the ink set excluding the clear protective ink, and the static surface tension of the clear protective ink is at least 2.0 mN/m lower than all other inks of the ink set excluding the yellow ink.

Surfactants may be added to adjust the surface tension of the inks to appropriate levels. The surfactants may be anionic, cationic, amphoteric, or nonionic and used at levels of 0.01 to 5% of the ink composition. Examples of suitable nonionic surfactants include: linear or secondary alcohol ethoxylates (such as the Tergitol® 15-S and Tergitol® TMN series available from Union Carbide and the Brij® series from Uniquema); ethoxylated alkyl phenols (such as the Triton® series from Union Carbide); fluoro surfactants (such as the Zonyls from DuPont; and the Fluorads from 3M); fatty acid ethoxylates, fatty amide ethoxylates, ethoxylated and propoxylated block copolymers (such as the Pluronic® and Tetronic® series from BASF); ethoxylated and propoxylated silicone based surfactants (such as the Silwet® series from CK Witco); alkyl polyglycosides (such as the Glucopons® from Cognis); and acetylenic polyethylene oxide surfactants (such as the Surtynols from Air Products).

Examples of anionic surfactants include: carboxylated (such as ether carboxylates and sulfosuccinates); sulfated (such as sodium dodecyl sulfate); sulfonated (such as dodecyl benzene sulfonate, alpha olefin sulfonates, alkyl diphenyl oxide disulfonates, fatty acid taurates and alkyl naphthalene sulfonates); phosphated (such as phosphated esters of alkyl and aryl alcohols, including the Strodex® series from Dexter Chemical); phosphonated and amine oxide surfactants; and anionic fluorinated surfactants. Examples of amphoteric surfactants include: betaines; sultaines; and aminopropionates. Examples of cationic surfactants include: quaternary ammonium compounds; cationic amine oxides; ethoxylated fatty amines; and imidazoline surfactants. Additional examples of the above surfactants are described in "McCutcheon's Emulsifiers and Detergents: 2003. North American Edition."

A biocide may be added to an ink jet ink composition to suppress the growth of micro-organisms such as molds, fungi, etc. in aqueous inks. A preferred biocide for an ink composition is Proxel® GXL (Zeneca Specialties Co.) at a final concentration of 0.0001-0.5 wt. %. Additional additives which may optionally be present in an ink jet ink composition include: thickeners; conductivity enhancing agents; anti-kogation agents; drying agents; waterfast agents; dye solubilizers; chelating agents; binders; light stabilizers; viscosifiers; buffering agents; anti-mold agents; anti-curl agents; stabilizers; and defoamers.

The pH of the aqueous ink compositions may be adjusted by the addition of organic or inorganic acids or bases. Useful inks may have a preferred pH of from about 2 to 10. depending upon the type of dye or pigment being used. Typical inorganic acids include hydrochloric, phosphoric, and sulfuric acids. Typical organic acids include methanesulfonic, acetic, and lactic acids. Typical inorganic bases include alkali metal hydroxides and carbonates. Typical organic bases include ammonia, triethanolamine, and tetramethylethlenediamine.

The exact choice of ink components will depend upon the specific application and performance requirements of the printhead from which they are jetted. Thermal and piezoelectric drop-on-demand printheads and continuous printheads each require ink compositions with a different set of physical properties in order to achieve reliable and accurate jetting of the ink, as is well known in the art of inkjet printing. Acceptable viscosities are no greater than 20 cP, and preferably in the range of about 1.0 to 6.0 cP.

For color inkjet printing, a minimum of cyan, magenta, and yellow inks are most commonly used for an inkjet ink set which is intended to function as a subtractive color system. Very often black ink is added to the ink set to decrease the ink required to render dark areas in an image and for printing of black and white documents such as text. The need to print on both microporous photoglossy and plain paper receivers can make it desirable to have a plurality of black inks in an ink set. In this case, one of the black inks may be better suited to printing on microporous photoglossy receivers while another black ink may be better suited to printing on plain paper. Use of separate black ink formulations for this purpose can be justified based on desired print densities, printed gloss, and smudge resistance for the type of receiver.

Other inks can be added to the ink set. These inks include light or dilute cyan, light or dilute magenta, light or dilute black, red, blue, green, orange, gray, and the like. Additional inks can be beneficial for image quality but they add system complexity and cost. Finally, colorless ink composition can be added to the inkjet ink set for the purpose of providing gloss uniformity, durability and stain resistance to areas in the printed image which receive little or no ink otherwise. Even for image areas printed with a significant level of colorant-containing inks, the additional colorless ink composition can provide further benefits to those areas. An example of a protective ink for the above purposes is described in US Patent Publication Nos. 2006/0100306 and 2006/0100308.

Typically the colorants used in inkjet printing are anionic in character. In dye based printing systems, the dye molecules contain anionic moieties. In pigment based printing systems, the dispersed pigments are functionalized with anionic moieties. Colorants must be fixed near the surface of the inkjet receiver in order to provide the maximum image density. In the case of pigment based printing systems, the inkjet receiver is designed with the optimum pore size in the top layer to provide effective trapping of ink pigment particles near the surface. Dye-based printing systems known in the conventional art require a fixative or mordant in the top layer or layers of the receiver. Polyvalent metal ions and insoluble cationic polymeric latex particles provide effective mordants for anionic dyes. Both pigment and dye based printing systems are widely available. For the convenience of the user, a universal porous inkjet receiver known in the conventional art will comprise a dye fixative in the topmost layer or layers.

Although the recording elements disclosed herein have been referred to primarily as being useful for inkjet printers, they also can be used as recording media for pen plotter assemblies. Pen plotters operate by writing directly on the surface of a recording medium using a pen consisting of a bundle of capillary tubes in contact with an ink reservoir.

The following examples further illustrate the invention.

EXAMPLES

Ink Preparation:

In order to prepare the pigment-based inks of the ink set used in the Examples and the comparisons, pigment dispersions for each ink color were first made according to the descriptions given below.

Cyan Pigment Dispersion:

A mixture of Pigment Blue 15:3. potassium salt of oleylmethyl taurate (KOMT) and deionized water were charged into a mixing vessel along with polymeric beads having mean diameter of 50 mm, such that the concentration of pigment was 20% and KOMT was 25% by weight based on pigment. The mixture was milled with a dispersing blade for over 20 hours and allowed to stand to remove air. Milling media were removed by filtration and the resulting pigment dispersion was diluted to approximately 10% pigment with deionized water to obtain the cyan pigment dispersion.

Magenta Pigment Dispersion:

The process used for cyan pigment dispersion was used except Pigment Red 122 was used in place of Pigment Blue 15:3 and the KOMT level was set at 30% by weight based on the pigment.

Yellow Pigment Dispersion:

The process used for cyan pigment dispersion was used except Pigment Yellow 155 was used in place of Pigment Blue 15:3.

First Black Pigment Dispersion:

The process used for cyan pigment dispersion was used except Pigment Black 7 was used in place of Pigment Blue 15:3.

In addition to the pigment dispersions, polymeric binder components are added to the inks to provide desirable attributes such as image durability and gloss uniformity. Specific polymeric additives and polymeric beads added to the inks in the below examples were:

Acrylic Polymer: benzylmethacrylate/methacrylic acid copolymer having an acid number of about 135 as determined by titration method, a weight average molecular weight of about 7160 and number average molecular weight of 4320 as determined by the Size Exclusion Chromatography. The polymer is neutralized with potassium hydroxide to have a degree of neutralization of about 85%.

Polyurethane Binder: polycarbonate-type polyurethane having a 76 acid number with a weight average molecular weight of 26,100 made with isophorone diisocyanate and a combination of poly(hexamethylene carbonate) diol and 2,2-bis(hydroxymethyl)proprionic acid where 100% of the acid groups are neutralized with potassium hydroxide.

Microgel particles: aqueous suspension of methyl methacrylate/divinyl benzene/methacrylic acid particles having fiftieth percentile particle size of 79 nm.

The inks were prepared by simple admixture of the components with stirring for at least one hour followed by 1.2 micron filtration. The Ink Set Table below provides relative weights of each component in the inks of the ink set. All of the pigments are added as dispersions prepared according to the description above except the Orient CW-3 carbon black pigment dispersion was used as supplied. The amount of dispersion added to the ink was adjusted to provide the weight percent of pigment shown in the Ink Set Table below. The amount of acrylic polymer additive, polyurethane binder additive, and microgel suspension were also adjusted to provide the weight percent of polymer or microgel particles shown in the Ink Set Table.

INK SET TABLE

| | Ink Set 1 | | | | | |
|---|---|---|---|---|---|---|
| Component | C-1 | M-1 | Y-1 | Bk1-1 | P-1 | Bk2-1 |
| pigment blue 15:3 | 2.20 | | | | | |
| pigment red 122 | | 3.00 | | | | |
| pigment yellow 155 | | | 2.75 | | | |
| pigment black 7, PB15:3, PR122 | | | | 2.50* | | |
| Orient CW-3 pigment (self-dispersed carbon black) | | | | | | 4.50 |
| acrylic polymer | 0.90 | 0.90 | 1.50 | 0.90 | 0.80 | 0.40 |
| polyurethane binder | 1.20 | 1.20 | 1.60 | 1.20 | 2.40 | |
| microgel particles | | | | | 0.20 | |
| Glycerol | 7.50 | 8.00 | 10.0 | 8.00 | 12.0 | 3.00 |
| ethylene glycol | 4.50 | 5.00 | 2.00 | 4.00 | 6.00 | |
| diethylene glycol | | | | | | 9.00 |
| polyethylene glycol 400 MW | | | | | | 3.00 |
| STRODEX PK-90 (anionic phosphate ester surfactant) | | | | 0.41 | | |
| SURFYNOL 465 (acetylenic non-ionic surfactant) | 0.75 | 0.50 | | | | |
| TERGITOL 15-S-5 (low HLB secondary alcohol ethoxylate non-ionic surfactant) | | | 0.75 | | 1.00 | |
| TERGITOL 15-S-12 (mid HLB secondary alcohol ethoxylate non-ionic surfactant) | | | | | | 0.40 |
| KORDEX MLX biocide | 0.02 | 0.02 | 0.02 | 0.02 | 0.02 | 0.02 |
| triethanolamine | 0.05 | 0.05 | | 0.05 | | |
| Water | Bal. | bal. | bal. | bal. | bal. | bal. |
| static surface tension mN/m | 35.8 | 36.2 | 31.4 | 33.8 | 30.2 | 34.0 |
| dynamic surf. ten. @ 10 ms. | 40.7 | 44.1 | 47.7 | 46.9 | 43.6 | 52.8 |

*1.625% PB7, 0.375% PB15:3, 0.50% PR122

The static and dynamic surface tension values reported in the Ink Set Table were measured at approximately 25° C.

The cyan, magenta, yellow, first black, and colorless protective inks from the ink set were placed in the appropriate chamber of a KODAK No. 10 five chamber color ink cartridge. The second black ink was placed in a KODAK No. 10 single chamber black ink cartridge. Each cartridge was then mounted in a KODAK model 5100 thermal ink jet printer followed by a standard ink priming step to bring ink from the cartridge through the print head ink flow channels. Printing was done using the printing mode optimized for ink set 1 when printed on KODAK ULTRA PREMIUM STUDIO GLOSS receiver.

Evaluation methods:

Cracking of the coated samples was assessed visually. The gloss of the unprinted samples was measured at 20 and 60 degrees. The samples were printed using a KODAK EASYSHARE 5100 Inkjet Printer with a driver setting selected such that print speed and ink laydown were maximized (KODAK ULTRA PREMIUM STUDIO GLOSS PAPER selection). Coalescence, or local density non-uniformity in solid color patches, was assessed visually and rated on a scale of 1 (none visible) to 5 (significant coalescence observed under conditions in which the selected printer mode provides a very high ink flux, up to, but not including "flooding"). Ratings up to 4 may be considered acceptable for some printing applications. Samples that were flooded with ink as well as coalesced were rated higher than 5.

Unless otherwise stated, all amounts in sample preparations described below refer to dry weights as coated.

The following examples further illustrate the invention.

Example 1

A resin-coated paper support was coated with a subbing layer comprising borax (0.16 g/m$^2$) and PVP (K-90) poly (vinyl pyrrolidone) binder (0.16 g/m$^2$) and dried. Aqueous coating compositions (17.9% solids) comprising a dispersion (Degussa W7520) of anionic fined silica (AEROSIL 200), PVA (Nippon Gohsei KH20), DHD (0.8%), and fluorosurfactant ZONYL FS300 (1%) were coated over the subbed support. Total dry weight was 19.4 g/m$^2$. The relative proportions of PVA in the compositions are given in Table 1. The silica dispersions made up the remainder of the dry weight. Comparative aqueous coating compositions comprising a dispersion (Degussa WK7525) of cationic fumed silica (AEROSIL 200), instead of the anionic fumed silica, were also prepared in the absence of fluorosurfactant and coated over an identical subbed support. In Table 1 below the column Gloss P (20 degree) refers to the gloss at 20 degrees of a patch printed with colorless protective ink described in the Ink Set Table above and Gloss Y similarly refers to a patch printed with yellow pigment-based ink of the Ink Set Table above.

TABLE 1

| Sample | Type | PVA (% total solid) | Cracking | Dmin Gloss (20 deg) | Gloss (P) (20 deg) | Gloss (Y) (20 Deg) |
|---|---|---|---|---|---|---|
| I-1 | Anionic | 8 | No | 19 | 56 | 53 |
| I-2 | Anionic | 10 | No | 35 | 54 | 54 |
| I-3 | Anionic | 12.5 | No | 20 | 52 | 50 |
| C-1 | Cationic | 12.5 | Yes | n/a | n/a | N/a |
| C-2 | Cationic | 15 | Yes | n/a | n/a | N/a |
| C-3 | Cationic | 17.5 | Yes | n/a | n/a | N/a |
| C-4 | Cationic | 20 | No | 17 | 42 | 35 |

The results of the evaluations shown in Table 1 demonstrate that crack-free single-layer coatings providing 19 g/m$^2$ of total dry weight are obtainable with a coating composition of anionic filmed silica when the relative amount of binder is from 8 to 12.5%. In order to provide a crack-free coating comprising cationically modified fumed silica of identical surface area, the relative proportion of binder must be increased to at least 20%. Surprisingly, the gloss of an unprinted area as well as areas printed with protective ink or with yellow pigment-based ink is significantly greater for the anionic silica formulations. In addition, the higher binder level used for the cationically modified silica might require a reduction of solids in the coating composition for coating at a manufacturing scale.

Example 2

A support comprising a paper with polyethylene resin coating on both sides was treated on one side by coating with an aqueous composition comprising poly (vinyl alcohol) (PVA, CELVOL 103), a styrene-butadiene latex (DOW CP692NA), and sodium tetraborate in a ratio of 1:1:2. at a total solids of 0.6% and dried to provide a dry coverage of 0.32 g/m$^2$.

A first aqueous coating composition (17.9% solids) for a base layer comprising a dispersion (DEGUSSA W7520) containing anionic fumed silica (AEROSIL 200), 7.5% PVA (NIPPON GOHSEI KH20), 0.75% (1,4-dioxane-2,3-diol (DHD)), 1% fluorosurfactant (ZONYL FS300), and a second aqueous coating composition (10% solids) for a gloss layer comprising a dispersion of anionic colloidal silica (1:1 mixture of Grace Davison SYLOJET 4000A and LUDOX TM-50), 8% succinylated gelatin (GELITA IMAGEL MS), a crosslinker (0.8% 1,4-dioxane-2,3-diol (DHD)), and a coating aid (1% ZONYL FS300) were simultaneously coated on the subbing layer to provide layers of dry weight 21.5 g/m$^2$ and 2.2 g/m$^2$, respectively, and dried to form inventive Sample I-4.

Comparative Samples C5 to C9 employed an identically treated support as described above. A first aqueous coating composition (17.9% solids) for a base layer comprising a dispersion (DEGUSSA WK7330) containing cationic fumed silica (cationically modified AEROSIL 130); PVA (NIPPON GOHSEI KH20), 2.5% (1,4-dioxane-2,3-diol (DHD)), 0.5% boric acid, and 1.85% coating aid (10G, DIXIE CHEMICAL), and a second aqueous coating composition (10% solids) for a gloss layer comprising a dispersion of cationic colloidal silica (Grace Davison SYLOJET 4000C); 3.5% polyvinyl alcohol (NIPPON GOHSEI GH23); 1% 1,4-dioxane-2,3-diol and 1% ZONYL FS300 were coated simultaneously on the subbing layer to provide layers of dry weight 21.5 g/m$^2$ and 2.2 g/m$^2$ respectively. The fumed silica-containing layer was varied with respect to PVA level, and the finned silica level was adjusted to compensate. The amounts of PVA used in Comparative Samples C5 to C9 are given in Table 2 below. The results are shown in Table 2 below.

TABLE 2

| Sample | Silica Type | Base Layer Binder (%) | Cracking | Pigment-based Ink Coalescence |
|---|---|---|---|---|
| C-5 | Cationic | 9 | Yes | 3 |
| C-6 | Cationic | 11 | Slight | 2.5 |
| C-7 | Cationic | 13 | No | 3 |
| C-8 | Cationic | 15 | No | 5 |
| C-9 | Cationic | 16.4 | No | 7 |
| I-4 | Anionic | 7.5 | No | 1.5 |

As demonstrated by the results in Table 2. the present inventors have discovered that a recording element of the present invention comprising anionic fumed silica in the ink receiving layer and anionic colloidal silica in the gloss layer may be coated with a lower binder content in the ink-receiving layer without cracking. As a result, reduced coalescence is obtained with pigment-based inks.

Example 3

A series of coatings was prepared according to the procedure for coating Sample I-4 of Example 2. except that the coating composition of the gloss layer was changed to 15% solids and the laydown was varied. Samples of the coating were evaluated as above and the test results are reported in Table 3 below.

TABLE 3

| Sample | Gloss layer coverage, g/m$^2$ | Coalescence | 20 degree gloss |
|---|---|---|---|
| I-4 | 4.3 | 2 | 32 |
| I-5 | 3.2 | 1.8 | 33 |
| I-6 | 2.2 | 1.5 | 31 |
| I-7 | 1.1 | 1.5 | 24 |

As demonstrated in Table 3. a slight increase in coalescence appears for gloss layer dry weight above 5 g/m$^2$.

Example 4

A series of coatings was prepared according to the procedure of Coating Sample I-4 in Example 2. except that the mixture of anionic colloidal silica types of the gloss layer was replaced by a single component, Grace Davison SYLOJET 4000A, and the gelatin binder in the gloss layer was replaced by poly(vinyl alcohol, except that the binder level in the ink-receiving layer was 7% by weight. The coat weights of the gloss layer and the ink-receiving layer were varied as shown in Table 4 below.

TABLE 4

| Sample | Base Layer coverage, g/m$^2$ | Gloss Layer coverage, g/m$^2$ | Total layer coverage, g/m$^2$ | Coalescence | Cracking |
|---|---|---|---|---|---|
| I-9 | 21.5 | 4.3 | 25.8 | 2 | Slight |
| I-10 | 21.5 | 3.2 | 24.7 | 2 | Very slight |
| I-11 | 21.5 | 2.2 | 23.7 | 2.5 | Good |
| I-12 | 19.4 | 4.3 | 23.7 | 3 | Very slight |
| I-13 | 19.4 | 3.2 | 22.6 | 4 | Good |
| I-14 | 19.4 | 2.2 | 21.6 | 3 | Good |
| I-15 | 16.1 | 4.3 | 20.4 | 6 | Good |
| I-16 | 16.1 | 3.2 | 19.3 | 6 | Good |
| I-17 | 16.1 | 2.2 | 18.3 | 6 | Good |

The results shown in Table 4 show preferred ranges for some embodiments of the invention, and demonstrate that an ink-receiving layer comprising at least 17 g/m$^2$ reduces coalescence compared with layers of less dry weight. The increased coalescence observed at lower base-layer dry weight may be compensated further by adjusting the base layer composition to increase absorption capacity or wetting. For example, as indicated in Example 13 below, increasing the amount of fluorosurfactant in the base layer can reduce coalescence at low base-layer coverage. As total dry weight of the combined base layer and gloss layer increases beyond 25 g/m$^2$, the receiver may be more prone to cracking during manufacture. The gloss coat coverage has a relative larger effect on cracking, while the ink-receiving dry layer weight has a relatively larger influence on image quality.

Example 5

A series of coatings was prepared according to the procedure for coating Sample I-4 in Example 2. except that the mixture of anionic colloidal silica types of the gloss layer was replaced by a single component, Grace Davison SYLOJET 4000A and the gloss layer dry weight was set at 3.2 g/m$^2$. The binder level for the ink-receiving layer was varied as shown in Table 5 below.

TABLE 5

| Sample | Base Layer coverage, g/m$^2$ | Base Layer binder level | Coalescence | Cracking |
|---|---|---|---|---|
| I-18 | 19.4 | 7.5% | 3 | Good |
| I-19 | 19.4 | 10% | 4 | Good |
| I-20 | 19.4 | 12.5% | 5 | Good |
| I-21 | 28 | 7.5% | 1.5 | Poor |
| I-22 | 28 | 10% | 2 | Slight |
| I-23 | 28 | 12.5% | 2.5 | Very slight |

The results shown in Table 5 demonstrate that base layer dry weights above 28 g/m$^2$ may result in increased cracking, whereas increasing relative dry binder content tends to increase coalescence.

Example 6

A treated support was prepared according to the procedure for coating Sample I-4 in Example 2. except that the borax-containing treatment layer comprised a 1:1 mixture of polyvinyl pyrrolidone (K-90. ISP Corp) and sodium tetraborate. A series of coatings was prepared with dispersions of cationic fumed silica for the ink-receiving layer. Aqueous cationic coating composition A (total solids 17.9%) was prepared to yield 82.6% cationic silica from a commercial dispersion WK7330 (dispersion of AEROSIL 130. Degussa); 12.5% polyvinyl alcohol) (KH-20); 2.5% Dihydroxy dioxane; 0.5% boric acid; and 1.9% 10G surfactant.

Cationic coating composition B was prepared according to the same formula as Composition A, except WK7525 (a cationic dispersion of AEROSIL 200 from Degussa) was used in place of WK7330 and cationic coating Composition C was prepared according to the same formula as composition B, except that the poly(vinyl alcohol) binder level was raised to 15%; and the level of silica was lowered to compensate. An aqueous cationic coating composition for the gloss layer was prepared at 10% solids, comprising 83.8% cationic colloidal silica (from SYLOJET 4000C dispersion available from Grace Davison); 10% cationic fumed silica (WK7330; Degussa); 4% poly(vinyl alcohol) (KH20); 1.1% dihydroxy dioxane; and 1.1% ZONYL FS300 surfactant.

A series of coating Samples C-9 to C-11 was prepared by simultaneously coating the cationic coating compositions for the ink-receiving layer and the cationic coating composition for the gloss layer in combination to yield dry coating weights of 21.5 g/m$^2$ for the ink-receiving layer and 2.2 g/m$^2$ for the gloss layer. In addition, an anionic coating identical in composition to sample I-4 in Example 2 was prepared, except that the binder in the gloss layer was changed to poly(vinyl alcohol), and the layers were coated on the same borax treatment layer used for the cationic comparative examples to provide coating Sample I-24. The samples were evaluated as in Example 1 and the results are shown in Table 6.

TABLE 6

| Sample | Gloss layer type | Base layer type | Base layer binder | Cracking | Coalescence |
|---|---|---|---|---|---|
| C-9 | Cationic | Cationic A | 12.5% | Good | 3.5 |
| C-10 | Cationic | Cationic B | 12.5% | Flaked off | (N/A) |
| C-11 | Cationic | Cationic C | 15% | Poor | 3.5 |
| I-24 | Anionic | Anionic | 7.5% | Good | 3 |

The results shown in Table 6 show that a larger particle size is preferable for the ink-receiving layer containing cationic silica than is preferred for a layer containing anionic silica, along with increased binder content relative to the formula employing anionic silica. While coalescence and cracking levels can approach those seen for the anionic layers of the invention, dye density is not as high.

Example 7

The Example demonstrates zeta potentials of silica particles used in various examples and comparative examples of the invention. The zeta potentials were measured using a Malvern ZETASIZER NANO-ZS. The results are shown in Table 7 below.

TABLE 7

| Dispersion | Silica | Type | Zeta (mV) |
|---|---|---|---|
| SYLOJET 4000A silica | Colloidal | Anionic | −40.1 |
| SYLOJET 4000C silica | Colloidal | Cationic | +36.1 |
| W7520 (AEROSIL 200) silica | Fumed | Anionic | −31.5 |
| W7330 (AEROSIL 130) silica | Fumed | Cationic | +33.8 |

As seen by the results in Table 7. anionic silica dispersions of the invention have zeta potentials more negative than negative 15 mv. The cationic silica dispersions have a zeta potential greater than +15 mv.

Example 8

Anionic coating compositions for the base layer and gloss layer were prepared corresponding to those used in Example 3. Cationic coating compositions for the base layer and gloss layer were prepared corresponding to those used in Example 6. The melts were combined with sting at room temperature to assess compatibility. The observations are recorded in Table 8.

TABLE 8

| Base Layer Composition | Gloss Layer Composition | Results upon combining |
|---|---|---|
| Anionic | Anionic | Compatible |
| Anionic | Cationic | Particles formed |
| Cationic | Cationic | Compatible |
| Cationic | Anionic | Agglomeration |

These observations suggest that the particles in the coating compositions must possess like charges in order to be compatible for successful simultaneous coating Example 9

A coating was prepared identical to Sample I-4. except that the dry weight of the gloss layer was increased to 3.2 g/m$^2$. A comparison coating was prepared by a sequential coating method, that is, the image-receiving layer was coated and dried and then the gloss layer was coated on top and dried. The printed gloss was evaluated using a KODAK EASY-SHARE 5100 printer. Patches of cyan, magenta, yellow, and protective ink were printed and then the 20-degree gloss of each patch was measured and the values averaged. The results are shown in Table 9.

TABLE 9

| Sample | Coating type | Unprinted 20 deg gloss | Printed 20 degree gloss (Ave CMY) | Coalescence |
|---|---|---|---|---|
| I-25 | Simultaneous | 31 | 79 | 2 |
| I-26 | Sequential | 21 | 57 | 3 |

The results of the simultaneous and sequential coating methods for anionic silica coating compositions shown in Table 9 demonstrate that the unprinted and printed gloss are superior for the preferred simultaneous coating method and the coalescence is reduced. While not wishing to be bound by any particular theory, the inventors surmise that the simultaneous coating method sufficiently alters the microstructure at the interface of the gloss and base layers of the receiver that it significantly improves the printed gloss and reduces coalescence with pigmented inks.

Example 10

Anionic coating compositions for the base and gloss layers were prepared as for Example 3. and cationic coating compositions for the base and gloss layers were prepared as in Example 6. The base layers were each coated over a borax-containing subbing layer as described in Sample I-4 and dried. The dried anionic base layer was subsequently coated with the cationic gloss composition and dried, while the cationic base layer was subsequently coated with the anionic gloss composition and dried. For comparison, the anionic base and gloss layer compositions were also coated simultaneously and dried, as were the cationic base and gloss layer compositions. The samples were evaluated as in Example 2 and the results are shown in Table 10.

TABLE 10

| Sample | Base Layer | Gloss Layer | 20 degree gloss | Coalescence |
|---|---|---|---|---|
| C-12 | Anionic | Cationic | 43 | 4 |
| C-13 | Cationic | Anionic | 23 | 3 |
| C-14 | Cationic | Cationic | 41 | 4 |
| I-27 | Anionic | Anionic | 32 | 1.5 |

The results shown in Table 10 demonstrate that the anionic structure I-27 of the invention provides the least amount of coalescence with very good gloss, compared to structures C-12 to C-14 comprising cationically modified silica.

Example 11

A series of coatings were prepared identical to Sample I-24. except that alternative anionic fumed silica dispersions from anionic fumed silica particles of different surface area were used and with the exception of the highest surface area silica (Sample I-31) that the binder level in the base layer was increased to 10%. The dispersions (all from Degussa) and their corresponding silica particle identity were, respectively, W7525 (AEROSIL 90), W7330N (AEROSIL 130), and W7622 (AEROSIL 300). The samples were evaluated for cracking and unprinted gloss and the results are shown in Table 11.

TABLE 11

| Sample | Silica Specific Surface area, m$^2$/g | Cracking | Unprinted 20 degree gloss |
|---|---|---|---|
| I-28 | 90 | Good | 3 |
| I-29 | 130 | Good | 8 |
| I-30 | 200 | Good | 31 |
| I-31 | 300 | Poor | 13 |

The results shown in Table 11 demonstrate that preferred specific surface areas of anionic fumed silica useful in the ink-receiving layer are between 150 m$^2$/g and 350 m$^2$/g for glossy receivers. The poor cracking behavior and low gloss of sample I-31 could be resolved by increasing the binder level, but this option may be less attractive from a manufacturing standpoint as it is likely that be reduced, hence slower coating, less productive drying speeds would be required.

Example 12

A series of coatings was prepared according to the procedure for Sample I-4 in Example 2. except that the relative weight of binder in the ink-receiver was lowered from 7.5 to 7.0% and a series of commercially available anionic colloidal silica particles were substituted in the coating composition for the gloss layer. The identity and particle size as provided by the manufacturer are given below in Table 12. In some cases, the commercially available colloidal silica dispersions comprise more than one particle size.

TABLE 12

| Sample | Colloidal silica | Colloidal silica particle size, nm | Unprinted 20 degree gloss | Coalescence |
|---|---|---|---|---|
| I-32 | LUDOX LS | 12 | 22 | 2.5 |
| I-33 | NALCO 1140 | 15 | 21 | 2 |
| I-34 | SYLOJET 4000A | 22 | 29 | 2 |
| I-35 | LUDOX TM-50 | 22 | 20 | 2 |
| I-36 | FUSO PL-3 | 35 | 18 | 2 |
| I-37 | NALCO 1060 | 60 | 12 | 2 |
| I-38 | FUSO PL-7 | 70 | 7 | 2 |
| I-39 | NALCO 2329 | 75 | 22 | 2 |

The results shown in Table 12 demonstrate that a gloss layer comprising colloidal silica particles of median particle size in the range 12 nm to 75 nm provides adequate unprinted gloss and low degree of coalescence when printed with pigment-based inks at high flux.

Example 13

A series of coatings were made identical to those in Sample I-24 of Example 6. except the amounts of PVA, fluorosurfactant ZONYL FS300. and total weight were varied. Gloss was measured and coalescence was assessed by printing with a KODAK EASYSHARE 5100 printer. The results are shown in Table 13.

TABLE 13

| Sample | PVA g/m$^2$ | Coverage, g/m$^2$ | FS | 20 deg gloss | Coalescence |
|---|---|---|---|---|---|
| I-40 | 8 | 21.5 | Yes | 26 | 1.5 |
| I-41 | 8 | 19.4 | Yes | 29 | 2 |
| I-42 | 8 | 17.2 | Yes | 27 | 2 |
| I-43 | 8 | 21.5 | No | 15 | 1 |
| I-44 | 8 | 19.4 | No | 15 | 2 |
| I-45 | 8 | 17.2 | No | 16 | 7 |
| I-46 | 10 | 21.5 | Yes | 24 | 1.5 |
| I-47 | 10 | 19.4 | Yes | 28 | 2 |
| I-48 | 10 | 17.2 | Yes | 24 | 3.5 |
| I-49 | 10 | 21.5 | No | 18 | 2.5 |
| I-50 | 10 | 19.4 | No | 20 | 2.5 |
| I-51 | 10 | 17.2 | No | 21 | 4 |
| I-52 | 12.5 | 21.5 | Yes | 24 | 1.5 |
| I-53 | 12.5 | 19.4 | Yes | 24 | 2.5 |
| I-54 | 12.5 | 17.2 | Yes | 21 | 3.5 |
| I-55 | 12.5 | 21.5 | No | 21 | 2.5 |
| I-56 | 12.5 | 19.4 | No | 19 | 3.5 |
| I-57 | 12.5 | 17.2 | No | 19 | 7 |

This data shows the complex relationship between binder level, fluorosurfactant level, gloss, and coalescence. As binder level increases, gloss decreases in the presence of fluorosurfactant but slightly decreases without it. Fluorosurfactant always improves coalescence, but at some binder levels coalescence and gloss may be sufficient for some applications even without fluorosurfactant.

Example 14

A series of coatings was prepared according to the procedure of Sample I-4. except that the base layer coverage was 23.7 g/m$^2$, the gloss layer coverage was 3.2 g/m$^2$, and poly (vinyl alcohol) type used in the ink-receiving layer was varied with respect to degree of hydrolysis and molecular weight. The molecular weight is typically characterized in the art by the viscosity of a 4% solution in water at 20° C., the values of which are supplied by the manufacturer. The degree of cracking was visually assessed and the unprinted gloss was measured. The results are given in Table 14 below.

TABLE 14

| Sample | PVA trademark (Nippon Gohsei) | Viscosity (cP) | Degree of Hydrolysis | Unprinted 20 degree gloss | Cracking |
|---|---|---|---|---|---|
| I-58 | KH20 | 44-52 | 78.5-81.5 | 31 | Good |
| I-59 | KH17 | 32-38 | 78.5-81.5 | 30 | Very slight |
| I-60 | KP-08 | 6-8 | 71-73.5 | 2 | Poor |
| I-61 | GH23 | 48-56 | 86.5-89 | 24 | Good |
| I-62 | AH22 | 50-58 | 97.5-98.5 | 10 | Poor |

The results presented in Table 14 demonstrate that the preferred poly(vinyl alcohol) binders have a molecular weight high enough to provide a viscosity 30 cP or more in a 4% solution in water at 20° C.; and a degree of hydrolysis of approximately 90 or less in order to provide preferred cracking resistance, gloss and compatibility with dispersions of anionic fumed silica without making other changes in the coating compositions such as limiting the thickness of the base layer or increasing the amount of binder.

The invention has been described with reference to a preferred embodiment. However, it will be appreciated that variations and modifications can be effected by a person of ordinary skill in the art without departing from the scope of the invention.

The invention claimed is:

1. An inkjet recording element having a support and the following ink-receiving layers:

(a) a porous base layer comprising particles of anionic fumed silica and hydrophilic hydroxyl-containing polymer as the primary binder crosslinked with crosslinker comprising boron-containing compound, wherein the porous base layer has a dry weight of about 10 to 35 g/m$^2$, wherein the weight percent of total binder to total solids in the porous base layer is greater than 5.0 percent and less than 15.0 percent; and (b) optionally, an uppermost porous gloss layer above the porous base layer comprising particles of anionic colloidal silica and hydrophilic binder and having a dry weight of 0.2 to 7.5 g/m$^2$, wherein the uppermost porous gloss layer is characterized by the absence of cationic polymer;

wherein the particles of anionic fumed silica and the particles of anionic colloidal silica exhibit a zeta potential below negative 15 mv, and the base layer is characterized by the absence of cationic materials in an amount that would render the zeta potential of the anionic silica particles more positive than negative 15 mv; and wherein the ink-receiving layers in the inkjet recording element consists of one or two porous layers, either the porous base layer alone or the porous base layer and the uppermost porous gloss layer, above the support and any optional subbing layer.

2. The inkjet recording element of claim 1 wherein the median primary particle size of the particles of anionic fumed silica is under 40 nm.

3. The inkjet recording element of claim 1 wherein the porous base layer is at least two times the dry weight of the uppermost porous gloss layer.

4. The inkjet recording element of claim 1 wherein the particles of anionic colloidal silica in the uppermost porous gloss layer comprise a mixture of two different populations of colloidal silica that are separately made and then admixed.

5. The inkjet recording element of claim 1 wherein the anionic fumed silica in the porous base layer comprises at least about 70 percent by weight of the total inorganic particles in the porous base layer.

6. The inkjet recording element of claim 1 wherein the porous base layer comprises less than 12 weight percent binder.

7. The inkjet recording element of claim 1 wherein the polymer in the porous base layer comprises modified or unmodified poly(vinyl alcohol) or copolymers thereof.

8. The inkjet recording element of claim 1 wherein the polymer in the porous base layer comprises poly(vinyl alcohol).

9. The inkjet recording element of claim 8 wherein the poly(vinyl alcohol) has a degree of hydrolysis of at least 70-percent.

10. The inkjet recording element of claim 1 wherein the porous base layer further comprises fluorosurfactant.

11. The inkjet recording element of claim 1 wherein the median primary particle size of the particles of anionic colloidal silica is under 30 nm.

12. The inkjet recording element of claim 1 wherein the uppermost porous gloss layer comprises less than 10 weight percent binder, based on total solids in the uppermost porous gloss layer.

13. The inkjet recording element of claim 1 wherein the anionic colloidal silica in the uppermost porous gloss layer comprises at least about 70 percent by weight of the total inorganic particles in the uppermost porous gloss layer.

14. The inkjet recording element of claim 1 wherein the support comprises cellulosic paper.

15. The inkjet recording element of claim 1 wherein the support comprises resin-coating paper.

16. The inkjet recording element of claim 1 consisting of the porous base layer and the uppermost porous gloss layer, over the support and any optional subbing layer.

17. An inkjet printing process comprising the steps of:

(A) providing an inkjet printer that is responsive to digital data signals;

(B) loading the inkjet printer with an inkjet recording element as described in claim 1;

(C) loading the inkjet printer with a pigmented inkjet ink composition; and (D) printing on the inkjet recording element using the inkjet ink composition in response to the digital data signals.

18. A packaged product comprising the inkjet recording element of claim 1 and a pigmented inkjet ink set comprising at least three colored ink compositions.

19. The inkjet recording element of claim 1 wherein the porous base layer is at least 6 times the dry weight of the uppermost porous gloss layer.

* * * * *